US007931497B2

(12) United States Patent
Yang et al.

(10) Patent No.: US 7,931,497 B2
(45) Date of Patent: Apr. 26, 2011

(54) ELECTRICAL CONNECTOR WITH AN IMPROVED METAL SHELL

(75) Inventors: Bo Yang, Kunshan (CN); Jia-Wei Gu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/875,687

(22) Filed: Sep. 3, 2010

(65) Prior Publication Data

US 2011/0059653 A1 Mar. 10, 2011

(30) Foreign Application Priority Data

Sep. 4, 2009 (CN) ..... 2009 2 0309646

(51) Int. Cl.
*H01R 13/60* (2006.01)

(52) U.S. Cl. ..... 439/567; 439/362; 439/607.4; 439/607.55; 439/607.37

(58) Field of Classification Search ..... 439/362, 439/567, 607.34, 607.37, 607.4, 607.55
See application file for complete search history.

(56) References Cited

U.S. PATENT DOCUMENTS

| | | | | |
|---|---|---|---|---|
| 4,929,184 | A * | 5/1990 | Emadi et al. | 439/362 |
| 5,249,974 | A * | 10/1993 | Wang | 439/607.35 |
| 5,564,945 | A * | 10/1996 | Domingos et al. | 439/567 |
| 5,921,811 | A * | 7/1999 | Hsu | 439/567 |
| 6,116,942 | A * | 9/2000 | Chen et al. | 439/362 |
| 6,210,220 | B1 * | 4/2001 | Zhu et al. | 439/567 |
| 6,688,903 | B2 * | 2/2004 | Kakinoki et al. | 439/362 |
| 6,860,751 | B1 * | 3/2005 | Huang | 439/362 |
| 6,932,647 | B2 * | 8/2005 | Murayama | 439/607.37 |
| 7,517,233 | B2 | 4/2009 | Xiang | |

* cited by examiner

*Primary Examiner* — Tho D Ta
(74) *Attorney, Agent, or Firm* — Wei Te Chung; Andrew C. Cheng; Ming Chieh Chang

(57) ABSTRACT

An electrical connector (100) for being mounted onto a PCB includes an insulative housing (1); a set of electrical contacts (2) retained in the insulative housing (1); and a metal shell (3) coupled to the insulative housing. the metal shell (3) has a pair of nuts (310) integrally protruding therefrom and defining threaded holes (3101) for screws of a complementary plug screwed into, and a pair of board locks (5) integrally extending therefrom for being mounted onto the PCB.

12 Claims, 5 Drawing Sheets

ELECTRICAL CONNECTOR WITH AN IMPROVED METAL SHELL

BACKGROUND OF THE INVENTION

1. Field of the Invention

The present invention relates to an electrical connector, and more particularly to electrical connectors with improved metal shells.

2. Description of Related Art

Electrical connectors present as a medium being widely used in computers and other electronic devices for electrically connecting the electronic device with each other to transmit signals. A common electrical connector usually includes an insulative housing, a plurality of contacts retained in the insulative housing for transmitting signals, a metal shell covering the insulative housing for shielding the electrical connector from being disturbed, a pair of board locks coupled to the insulative housing for being mounted onto a PCB, and a pair of nuts riveting the metal shell, the insulative housing, and the board locks together and having threaded holes for screws of a complementary mating plug screwed into.

However, the metal shell, the rivets, and the board locks must be produced separately and then assembled together to construct the electrical connector, the mass number of the elements will complicate the manufacture and assembly processes.

Hence, an improved electrical connector with an improved grounding means is desired to overcome the above problems.

BRIEF SUMMARY OF THE INVENTION

According to one aspect of the present invention, an electrical connector for being mounted onto a PCB comprises: an insulative housing; a plurality of electrical contacts retained in the insulative housing; and a metal shell coupled to the insulative housing, the metal shell comprising a pair of nuts integrally protruding therefrom and defining threaded holes for screws of a complementary plug screwed into, and a pair of board locks integrally extending therefrom for being mounted onto the PCB.

According to another aspect of the present invention, an electrical connector for being mounted onto a PCB comprises: an insulative housing defining a base portion and a mating portion extending forwardly from the base portion, the base portion has a pair of through holes passing therethrough along a front-to-rear direction and being located at two lateral sides of the mating portion; a plurality of contacts retained in the insulative housing and defining contacting portions retained in the mating portion, tail portions mounted onto the PCB, and connecting portions connecting the contacting portions and the tail portions; and a metal shell coupled to the insulative housing, the metal shell comprising a main portion leaning against a front face of the base portion backwardly, and a sleeve portion extending forwardly from the base portion and encircling the mating portion, the main portion has a pair of nuts integrally protruding therefrom and corresponding to the through holes, and a pair of board locks integrally extending therefrom for being mounted onto the PCB, the nuts having threaded holes for screws of a complementary plug screwed into.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
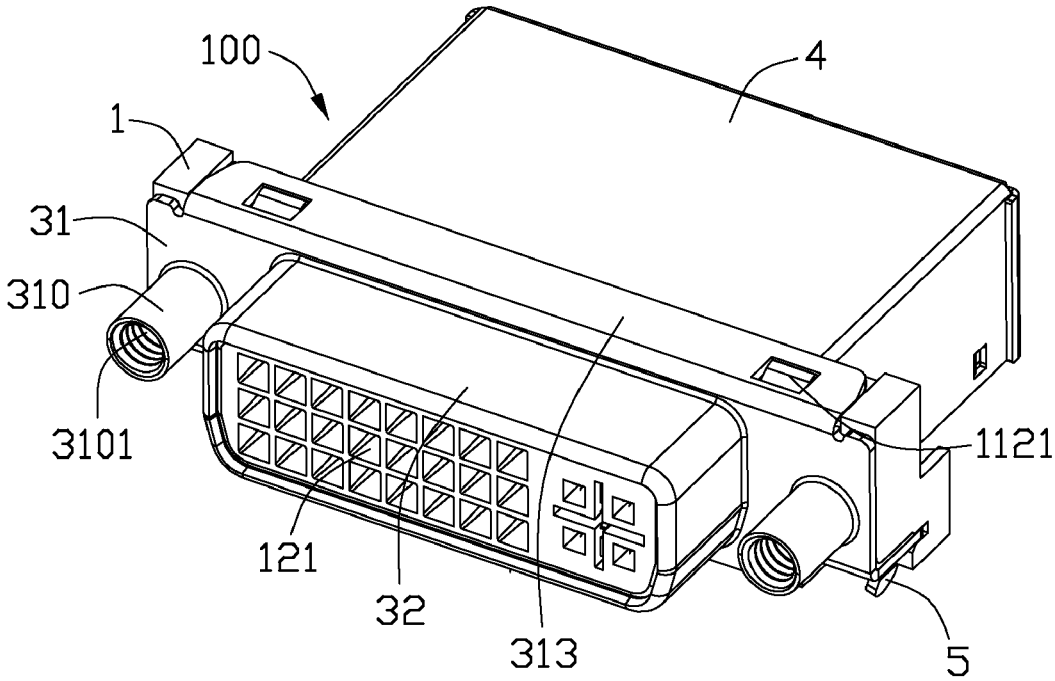
FIG. 1 is a perspective view of an electrical connector according to the present invention.
Figure 2:
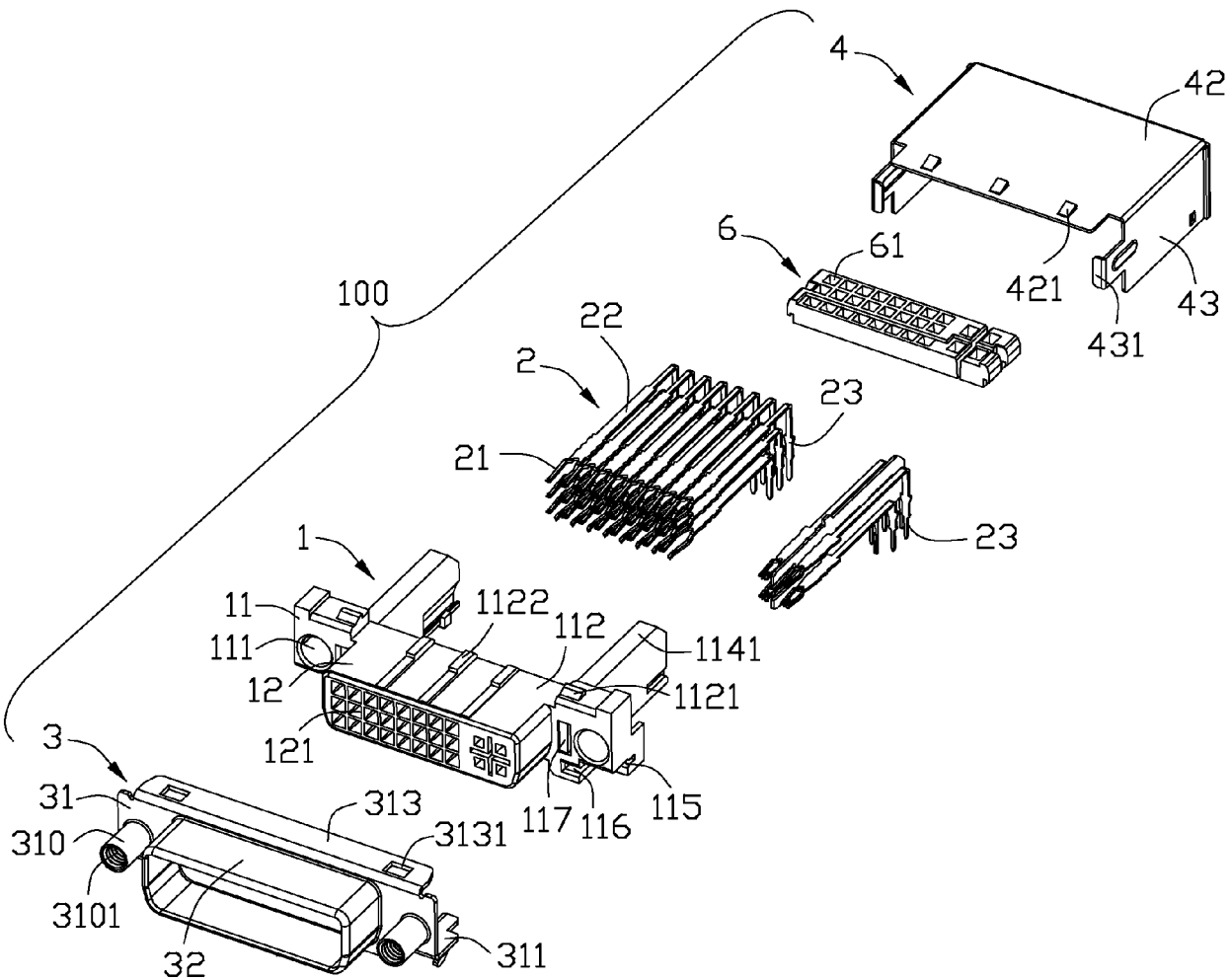
FIG. 2 is an exploded view of the electrical connector shown in FIG. 1.
Figure 3:
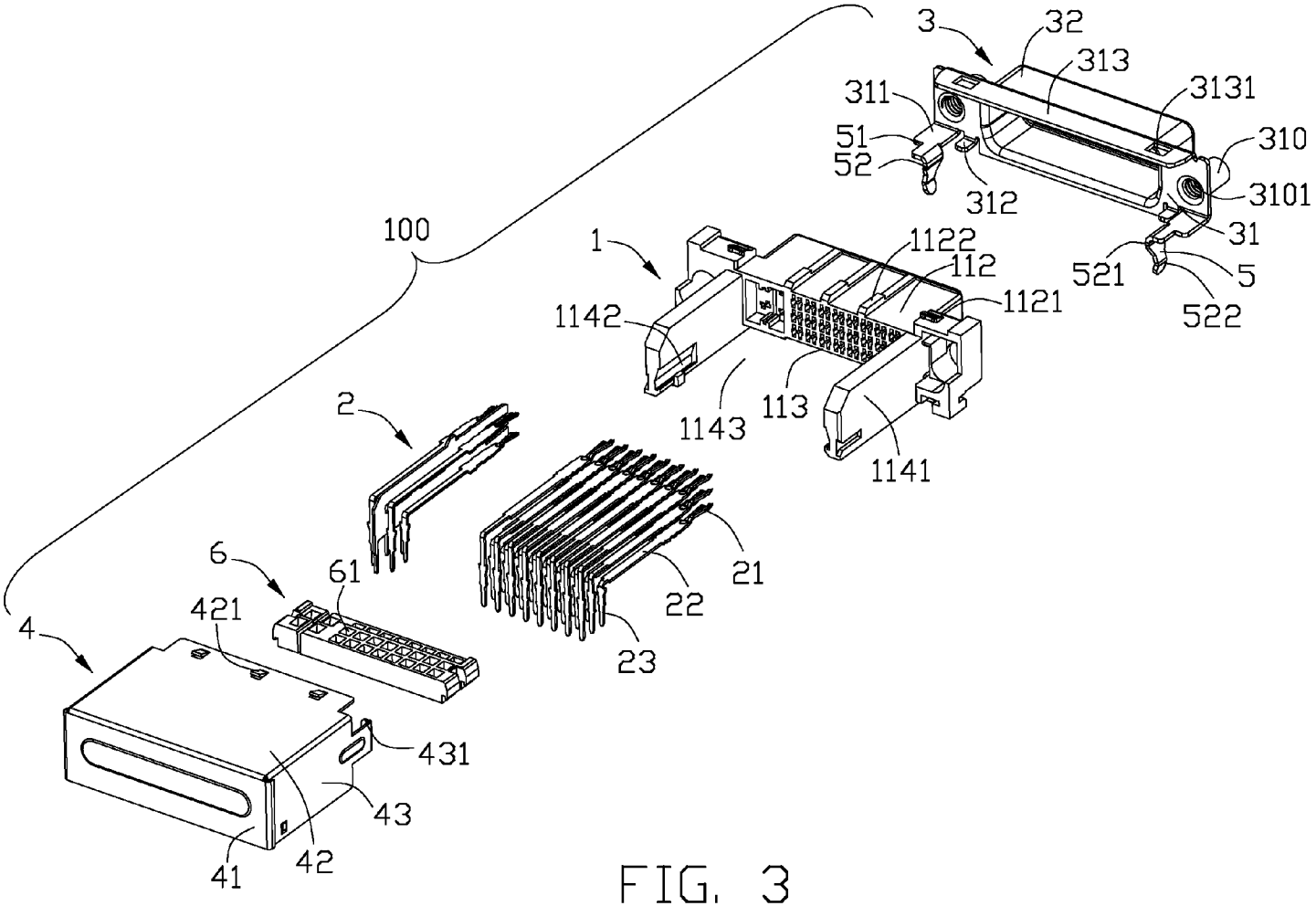
FIG. 3 is a view similar to FIG. 2, while taken from another aspect.
Figure 4:
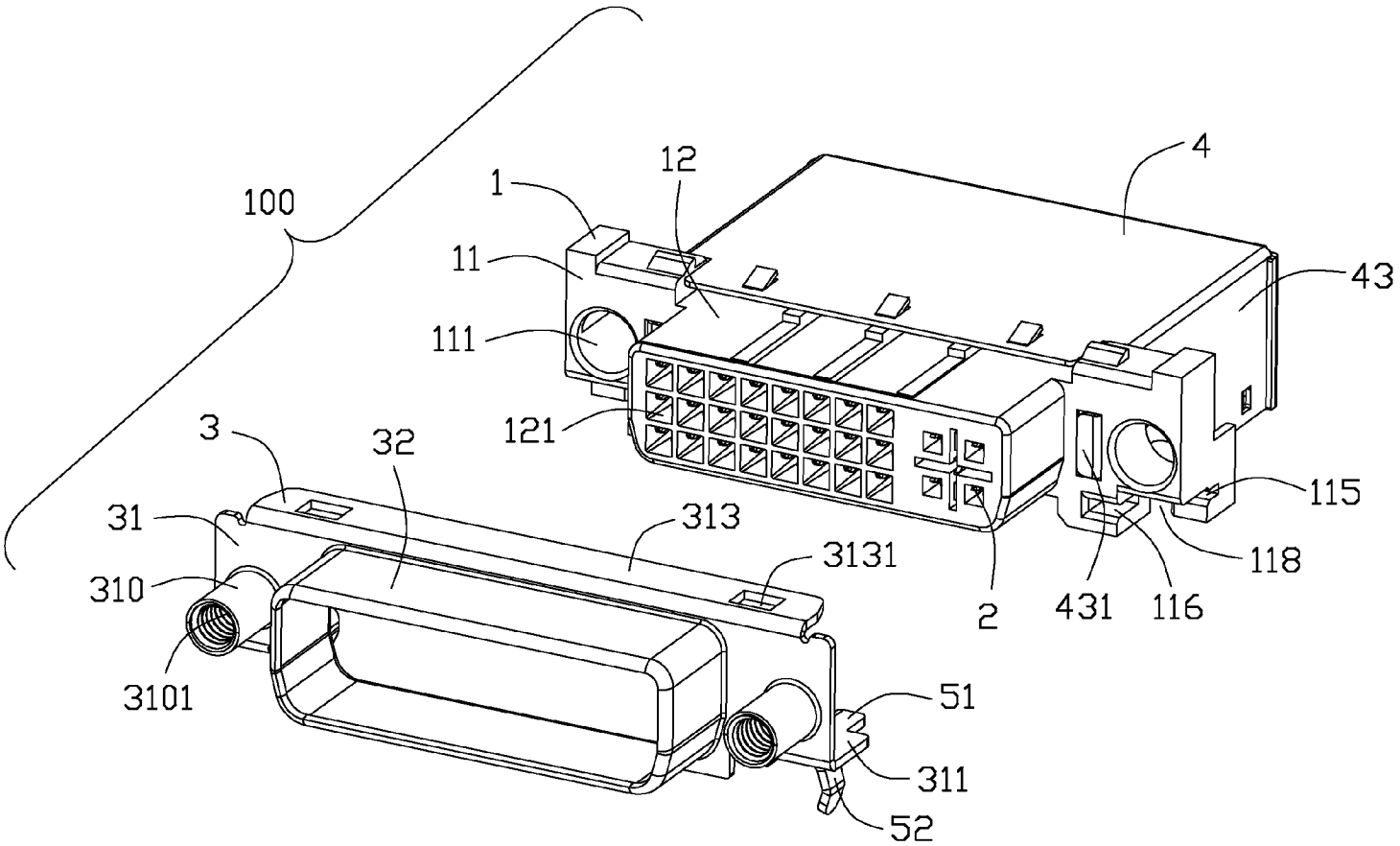
FIG. 4 is a partly exploded view of the electrical connector shown in FIG. 1.
Figure 5:
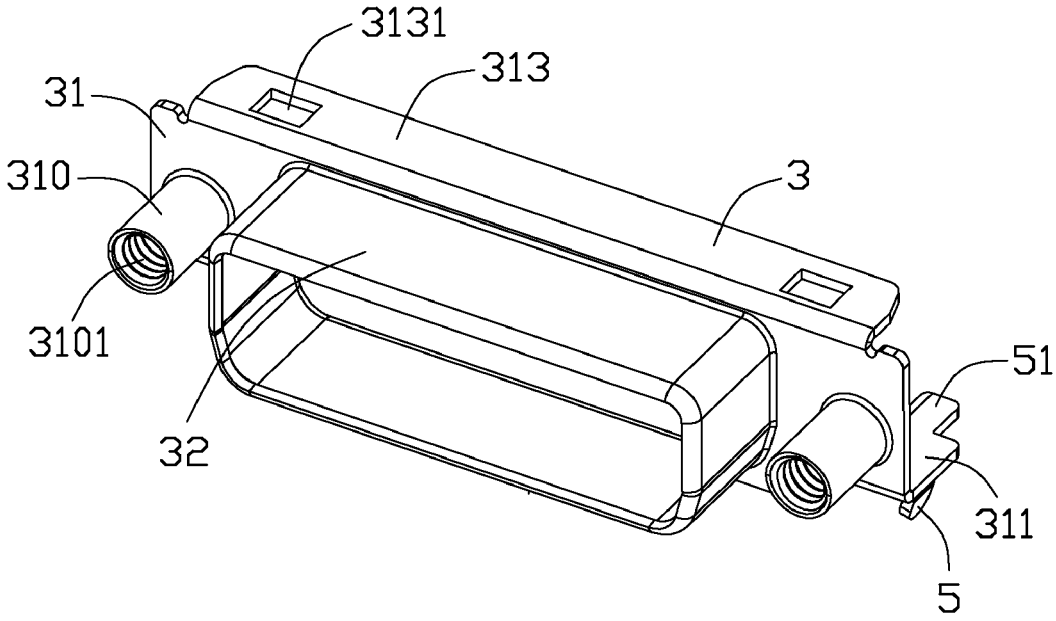
FIG. 5 is a perspective view of a metal shell of the electrical connector shown in FIG. 1.

Referring to FIGS. 1-5, an electrical connector 100 according to the present invention for being mounted onto a printed circuit board (PCB, not shown) is disclosed. The electrical connector 100 includes an insulative housing 1, a set of electrical contacts 2 retained in the insulative housing 1, a metal shell 3 for covering a front portion of the insulative housing 1, a metal cover 4 for covering a rear portion of the insulative housing 1 and contacting with the metal shell 3, and a spacer 4 coupled to the insulative housing 1 for retaining the electrical contacts 2.

Referring to FIGS. 2-5, the insulative housing 1 is molded of dielectric material such as plastic or the like, and includes a base portion 11, a mating portion 12 extending forwardly from a front end of the base portion 11 and defining a set of passageways 121 passing therethrough along a front-to-rear direction, and a pair of extending portions 1141 extending backwardly from a rear end of the base portion 11 and spaced apart from each other along a transverse direction perpendicular to the front-to-rear direction. A receiving space 1143 is formed among the base portion 11 and the extending portions 1141 and communicates with the passageways 121 in the front-to-rear direction. The base portion 11 has a pair of projections 1121 projecting upwardly from an upper surface 112 thereof for latching with the metal shell 3 and a set of ribs 1122 extending upwardly from the upper surface 112 for resisting the metal cover 4. The base portion 11 has a pair of through holes 111 passing therethrough along the front-to-rear direction and located at outsides of the extending portions 1141, a pair of apertures 117 passing therethrough along the front-to-rear direction and each located between the corresponding extending portion 1141 and through hole 111. The base portion 11 has a pair of retaining slots 115 and a pair of securing slots 116 recessed backwardly from a front face thereof and located below the through holes 111, a pair of notches 118 passing downwardly through a lower surface 113 thereof and each being located between the retaining slots 115 and the securing slot 116. The extending portions 1141 have a pair of grooves 1142 formed at inner sides thereof for retaining the spacer 6.

The electrical contacts 2 have contacting portions 21 extending into the passageways 121 for contacting with a complementary mating plug (not shown), tail portions 23 passing through retaining holes 61 formed on the spacer 6 for being mounted to the PCB, and connecting portions 22 connecting the contacting portions 21 and the tail portions 23 and being received in the receiving space 1143.

The metal shell 3 has a main portion 31 leaning against the front face of the base portion 11 backwardly, and a sleeve portion 32 extending forwardly from the main portion 31 and encircling the mating portion 12 for shielding the contacting portions 21. The main portion 31 has a pair of nuts 310 integrally extending forwardly therefrom, a pair of board locks 5 integrally extending from a lower end thereof for being mounted onto the PCB, and a pair of tabs 312 extending backwardly from the lower end and located between the board locks 5 for being retained in the securing slots 116 of the insulative housing 1. The nuts 310 have threaded holes 3101 for screws of the mating plug screwed into. The threaded hole 3101 passes through the nut 310 along the front-to-rear direction and communicates with the corresponding through hole 111. In another embodiment, the nuts 310 could integrally extend backwardly from the main portion 31 and pass through the through hole 111 to rivet on a rear face of the base portion 11, and the metal shell 3 could be retained on the insulative housing 1 firmly. The board lock 5 has a horizontal portion 311 extending horizontally from the lower end of the main portion 31, a retaining portion 51 extending backwardly from the horizontal portion 311 and being retained in the retaining slot 115 of the insulative housing 1, and a leg 52 extending downwardly from a lateral side of the retaining portion 51 and passing through the corresponding notch 118 for being mounted onto the PCB. The leg 52 includes a first arc portion 521 extending downwardly from the retaining portion and bowed inwardly, and a second arc portion 522 extending downwardly from a lower end of the first arc portion 521 and bowed outwardly. An upper plate 313 extends horizontally and backwardly from an upper end of the main portion 31 and has a pair of cavities 3131 for latching with the projections 1121. Therefore, the metal shell 3 is retained on the insulative housing 1 firmly. The base portion 11 is sandwiched between the upper plate 313 and the horizontal portions 311 in an upper to lower direction. In this invention, the nuts 310 and the board locks 5 are integrally formed with the metal shell 3, the number of the elements of the electrical connector 100 is decreased, and the assembly process will be simplified.

The metal cover 4 includes a top wall 42, a rear wall 41 bending downwardly from a rear end of the top wall 42, and a pair of side walls 43 bending downwardly from two lateral sides of the top wall 42. The top wall 42 covers the upper surface 112 of the base portion 11 and is resisted upwardly by the ribs 1122. A set of protrusions 421 protrude upwardly from the top wall 42 and contact with the upper plate 313. Therefore, the cover 4 could electrically contact with the metal shell 3, and the static electricity on the cover 4 could be eliminated via the board locks 5 which are integrally with the metal shell 3. A pair of clasps 431 extend forwardly from the corresponding side walls 43 and pass through the corresponding apertures 117. The clasps 431 bend inwardly at front ends thereof and clasp on the front face of the base portion 11 to contact with the main portion 31 reliably.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for being mounted onto a PCB, comprising:

an insulative housing;

a plurality of electrical contacts retained in the insulative housing; and a metal shell coupled to the insulative housing, the metal shell comprising a pair of nuts monolithically protruding therefrom and defining threaded holes for extension of screws of a complementary plug screwed thereinto, and a pair of board locks monolithically extending therefrom for being mounted onto the PCB;

wherein the insulative housing has a base portion and a mating portion protruding forwardly from the base portion, the base portion has a pair of through holes passing therethrough along a front-to-rear direction and being located at two lateral sides of the mating portion, the threaded holes pass through the nuts along the front-to-rear direction and communicate with the corresponding through holes;

wherein the metal shell comprises a main portion leaning against a front face of the base portion backwardly, and a sleeve portion extending forwardly from the base portion and encircling the mating portion, the nuts integrally protrude forwardly from the main portion, the board locks integrally extend from a lower end of the main portion;

wherein the board lock has a retaining portion extending horizontally and being retained in a retaining slot formed on the base portion, and a leg bending downwardly from a lateral side of the retaining portion for being mounted onto the PCB;

wherein the leg includes a first arc portion extending downwardly from the retaining portion and bowed outwardly, and a second arc portion extending downwardly from a lower end of the first arc portion and bowed inwardly.

2. The electrical connector according to claim 1, wherein the metal shell has a pair of tabs extending rearwardly from the lower end of the main portion and being retained in securing slots formed on the base portion, the base portion has a notch passing downwardly through a lower surface thereof and being located between the corresponding retaining slot and securing slot for the corresponding leg extending downwardly through.

3. The electrical connector according to claim 1, wherein the board lock further includes a horizontal portion extending horizontally from the lower end of the main portion and connecting with the retaining portion, the metal shell has an upper plate extending horizontally and backwardly from an upper end of the main portion, the upper plate has a pair of cavities for latching with projections formed on an upper surface of the base portion, the base portion is sandwiched between the upper plate and the horizontal portions in an upper- to-lower direction.

4. The electrical connector according to claim 3, wherein the electrical connector further comprises a metal cover having a top wall covering the upper surface of the base portion and a pair of side walls extending downwardly from two lateral sides of the top wall, the base portion has a set of ribs extending upwardly from the upper surface thereof for resisting the top wall upwardly.

5. The electrical connector according to claim 4, wherein the insulative housing has a pair of extending portions extending backwardly from the base portion and being spaced apart from each other along a transverse direction perpendicular to the front-to-rear direction, and a receiving space formed among the base portion and the extending portions for receiving the electrical contacts, the metal cover covering the receiving space, the side walls are positioned along outsides of the extending portions.

6. The electrical connector according to claim 4, wherein the top wall is sandwiched between the upper plate and the upper surface of the base portion, the top wall has a set of protrusions protruding upwardly for contacting with the upper plate.

7. The electrical connector according to claim 6, wherein the base portion has a pair of apertures passing therethrough along the front-to-rear direction, the side walls have a pair of clasps extending forwardly from the corresponding side walls and passing through the corresponding apertures, the clasps bend inwardly at front ends thereof and clasp on a front face of the base portion to contact with the main portion.

8. An electrical connector for being mounted onto a PCB, comprising:

an insulative housing defining a base portion and a mating portion extending forwardly from the base portion, the base portion has a pair of through holes passing therethrough along a front-to-rear direction and being located at two lateral sides of the mating portion;

a plurality of contacts retained in the insulative housing and defining contacting portions retained in the mating portion, tail portions mounted onto the PCB, and connecting portions connecting the contacting portions and the tail portions; and a metal shell coupled to the insulative housing, the metal shell comprising a main portion leaning against a front face of the base portion backwardly, and a sleeve portion extending forwardly from the base portion and encircling the mating portion, the main portion has a pair of nuts monolithically protruding therefrom and corresponding to the through holes, and a pair of board locks monolithically extending therefrom for being mounted onto the PCB, the nuts having threaded holes for screws of a complementary plug screwed into;

wherein the board lock comprises a horizontal portion extending horizontally from a lower end of the main portion, a retaining portion extending backwardly from the horizontal portion and being retained in a retaining slot formed on the base portion, and a leg bending downwardly from a lateral side of the retaining portion for being mounted onto the PCB;

wherein the leg includes a first arc portion extending downwardly from the retaining portion and bowed outwardly, and a second arc portion extending downwardly from a lower end of the first arc portion and bowed inwardly.

9. The electrical connector according to claim 8, wherein, the metal shell has an upper plate extending horizontally and backwardly from an upper end of the main portion, the upper plate has a pair of cavities for latching with projections formed on an upper surface of the base portion, the base portion is sandwiched between the upper plate and the horizontal portions in an upper- to-lower direction.

10. The electrical connector according to claim 9, wherein the insulative housing has a pair of extending portions extending backwardly from the base portion and being spaced apart from each other along a transverse direction perpendicular to the front-to-rear direction, and a receiving space formed among the base portion and the extending portions for receiving the connecting portions of the electrical contacts, the extending portions have a pair of grooves formed at inner sides thereof and communicating with the receiving space, the electrical connector comprises a spacer retained in the grooves and defining a plurality of retaining holes for the tail portions passing through.

11. The electrical connector according to claim 10, wherein the electrical connector further comprises a metal cover covering the receiving space, the metal cover has a top wall being sustained by the upper surface of the base portion, and a pair of side walls extending downwardly from two lateral sides of the top wall and being positioned along outsides of the extending portions, the base portion has a pair of apertures passing therethrough along the front-to-rear direction and being located at two lateral sides of the extending portions, the side walls has a pair of clasps extending forwardly from the corresponding side walls and passing through the corresponding apertures, the clasps bend inwardly at front ends thereof and clasp on the front face of the base portion to contact with the main portion.

12. An electrical connector for mounting to a printed circuit board and mating with a complementary connector, comprising:

an insulative housing defining a mating face at two opposite longitudinal end regions in a longitudinal direction to face the complementary connector and a mounting face facing to the printed circuit board, a mating island protruding upon the mating face in a mating direction and defining a plurality of passageways therein along said mating direction perpendicular to said longitudinal direction;

a plurality of contacts disposed in the housing with contacting sections located in the corresponding passageways, respectively;

a metallic shell including a front face covering the mating face in a direction opposite to said mating direction, and a frame like protrusion extending from the mating face in said mating direction to enclose the mating island; a pair of nuts monolithically extending from the front face in said mating direction and located by two sides of the frame like protrusion in said longitudinal direction; wherein each of said nut is equipped with inner threads for receiving a screw of the complementary connector;

wherein the end regions defines a pair of through holes in alignment with the corresponding nuts in said mating direction for receiving the corresponding screws of the complementary connector;

wherein said shell further includes a pair of board locks adjacent to the corresponding nuts, respectively, for mounting to the printed circuit board;

wherein said pair of board locks monolithically extending from said shell;

wherein said pair of board locks are located on another side of front face of the shell with regard to the corresponding nuts in said mating direction;

wherein the board lock has a retaining portion extending horizontally and being retained in a retaining slot formed on the mating face, and a leg bending downwardly from a lateral side of the retaining portion for being mounted onto the PCB;

wherein the leg includes a first arc portion extending downwardly from the retaining portion and transversely bowed either outwardly or inwardly, and a second arc portion extending downwardly from a lower end of the first arc portion and bowed transversely opposite to said first arc.

* * * * *